United States Patent [19]

Miller, Jr.

[11] Patent Number: 4,836,920

[45] Date of Patent: Jun. 6, 1989

[54] RECOIL WEB POOL SKIMMER

[76] Inventor: Joseph E. Miller, Jr., 811 New Galena Rd., Doylestown, Pa. 18901

[21] Appl. No.: 221,530

[22] Filed: Jul. 20, 1988

[51] Int. Cl.[4] ..... E04H 3/20

[52] U.S. Cl. ..... 210/169; 210/236; 210/238; 210/923; 210/405; 4/490; 4/496

[58] Field of Search ..... 210/154–156, 210/169, 232, 236, 238, 923, 106, 107, 405; 4/490, 496; 405/62–70

[56] References Cited

U.S. PATENT DOCUMENTS

| | | | |
|---|---|---|---|
| 2,367,997 | 1/1945 | Chambers | 210/169 |
| 4,053,412 | 10/1977 | Stix | 210/169 |
| 4,140,634 | 2/1979 | Harry | 210/169 |
| 4,295,755 | 10/1981 | Meyers | 405/63 |
| 4,472,842 | 9/1984 | Jarrett | 4/490 |
| 4,480,800 | 11/1984 | Öberg et al. | 210/923 |
| 4,557,001 | 12/1985 | Burkhart | 4/490 |

*Primary Examiner*—Richard V. Fisher
*Assistant Examiner*—Coreen Y. Lee
*Attorney, Agent, or Firm*—Gregory J. Gore

[57] ABSTRACT

The present device includes a recoiling roll of screening in a shape of an elongate rectangular web which is affixed to a vertical, rotatable spool at one end and a wand collar at the other. The screen roll is vertically oriented on a mounting frame which is affixed to the side of the pool, preferably adjacent to the automatic skimming water trap. The device may also include an outer canister with wiper brushes for wiping away debris which has been accumulated on the screening as it is retracted.

9 Claims, 4 Drawing Sheets

FIG. 1
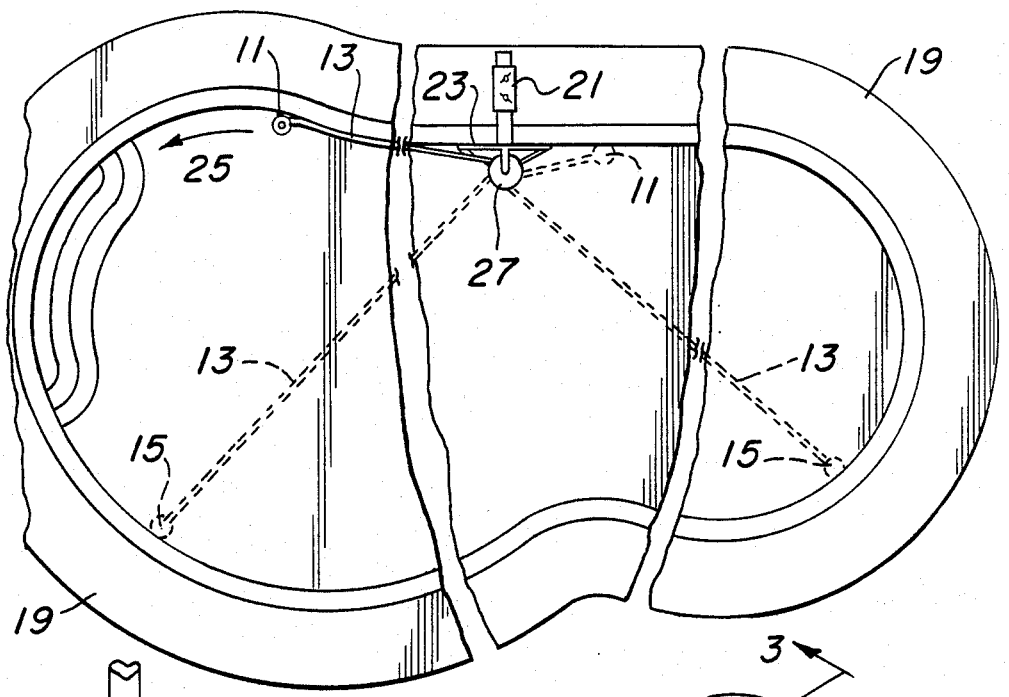
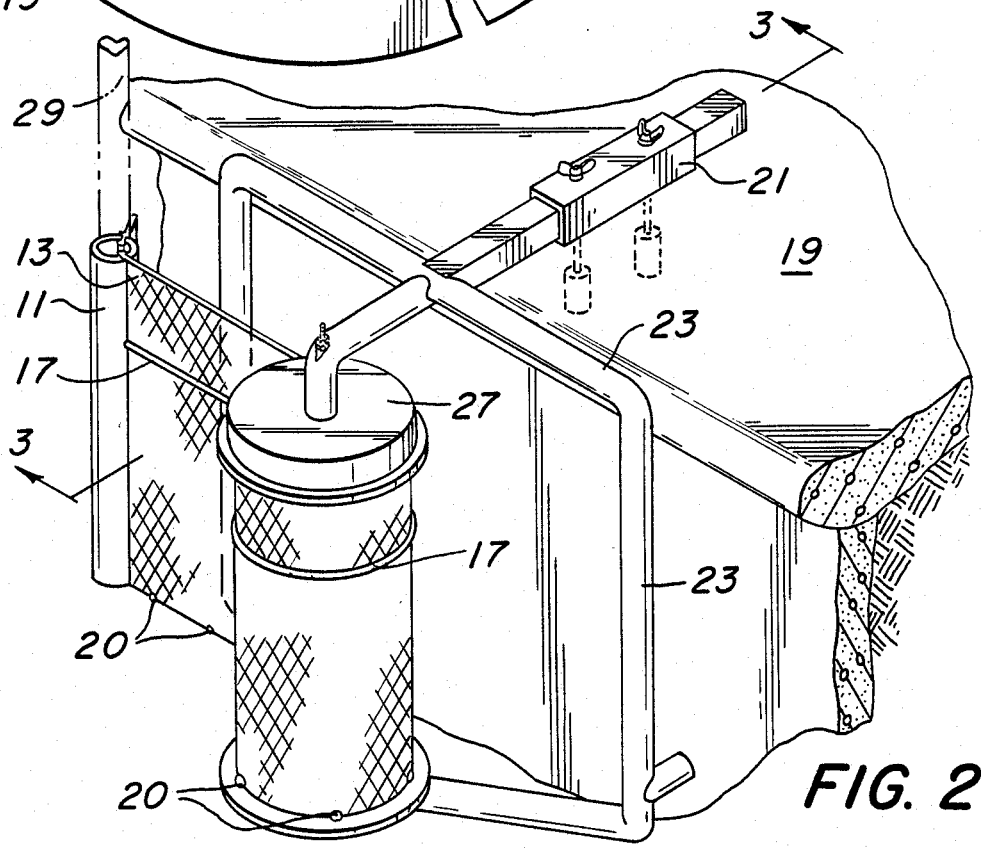
FIG. 2

FIG. 6
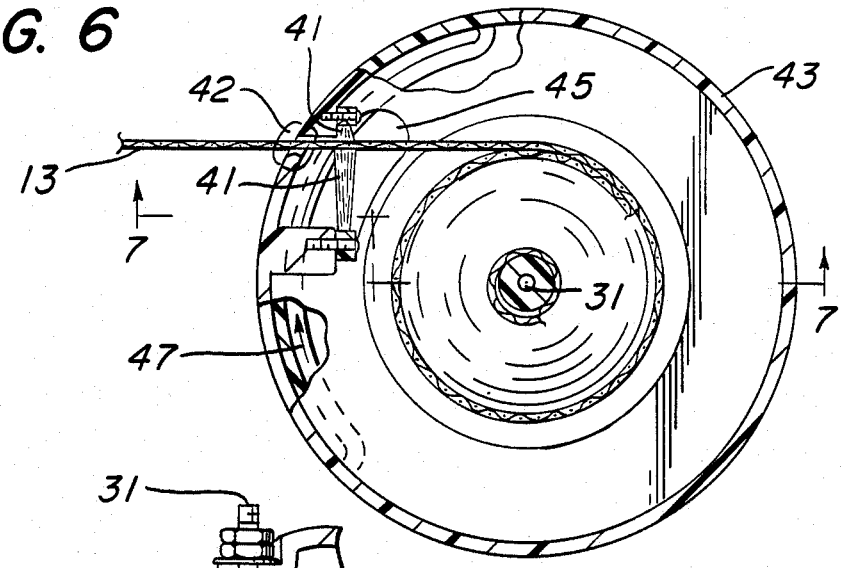
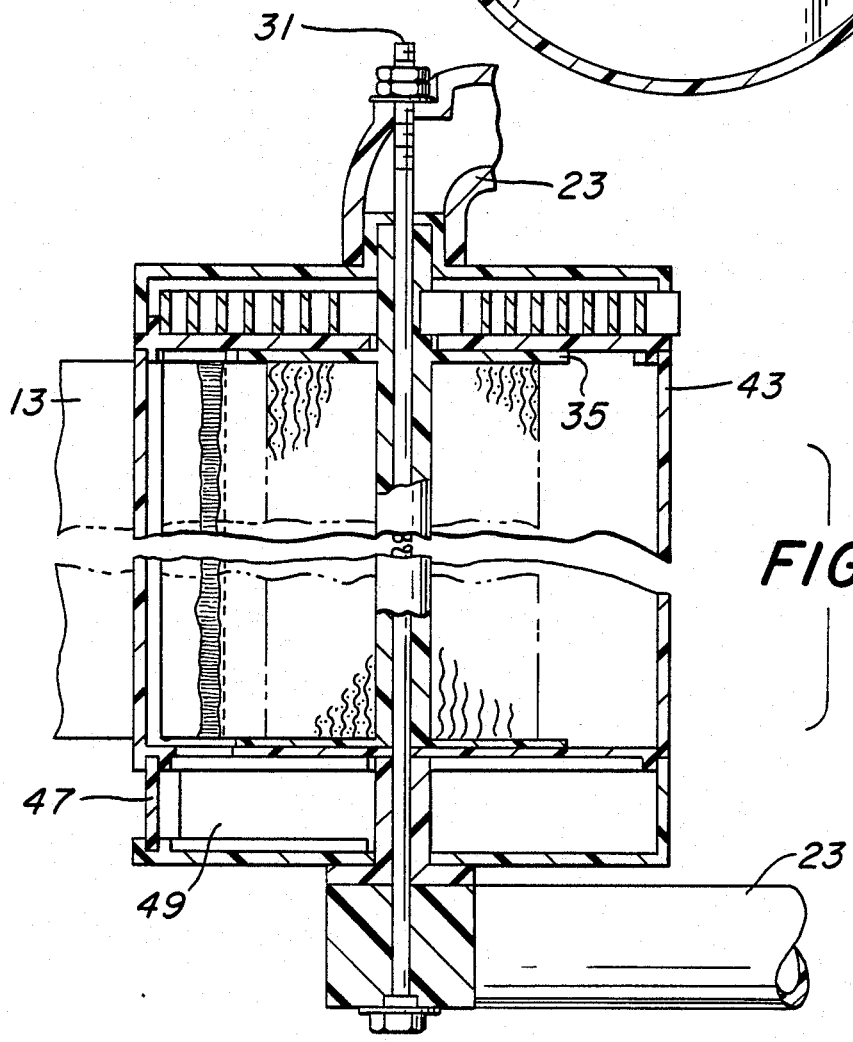
FIG. 7

RECOIL WEB POOL SKIMMER

FIELD OF THE INVENTION

This device relates to pool skimmers of the type that utilize a screen or perforated material for skimming floating debris from the surface of a body of water, such as a swimming pool.

BACKGROUND OF PRIOR ART

It is a well-known maintenance chore of swimming pool owners to skim off floating debris from the surface of their pool as a part of routine cleaning. The skimming operation is most often performed with a scoop-type skimmer which has an elongate handle at one end and screened pocket supported by a frame at the opposite end. Floating debris is skimmed from the surface of the pool by manually dipping the pool skimmer into the water and lifting out the debris which becomes trapped in the screening. The use of this tool makes the process extremely time-consuming, because the screen pocket must be cleaned many times so that debris is not re-introduced to the pool between each skimming operation. There exists, therefore, a need for a pool skimming device which is more efficient, less time-consuming and easier to use.

SUMMARY OF THE INVENTION

In order to overcome the deficiencies in the prior art mentioned above and in order to meet the need for an improved pool skimmer, the present device has been created. The present invention includes a roll of screening in the shape of an elongate, rectangular web which is affixed to a vertical recoiling spool at one end, and a wand collar at the other. The screen roll is vertically oriented on a mounting frame which is affixed to the side of the pool, preferably adjacent to the automatic skimming water trap. The screen roll is rotatable and resiliently biased to wind up so that when not under tension supplied by the operator at the wand end, the skimming web will automatically retract into the winding roll. The roll may also include an outer canister with wiper brushes for wiping away debris which has been accumulated on the screening as it is retracted.

In operation, the user inserts an elongate wand with a handle into a collar at one end of the screening web and, beginning at a point near the screen roll, leads the wand around the outer periphery of the swimming pool. The wand holds the screening in a vertical orientation with portions of the screen above and below the surface of the water. As the screen is moved through the water, it collects debris along the face of the screen in the direction of its motion. Debris which adheres to the screen is pulled into the roll as it retracts and is held there between circular wraps of the screen. Debris which does not adhere to the face of the screening is herded into a compact area and easily fed into the skimmer trap located near the screen roll. The screen roll may also include an outer canister and wiper brushes which dislodge any debris which adheres to the skimmer screen and then collects the debris in the canister.

It is therefore an object of the present invention to provide a swimming pool skimmer which quickly and efficiently removes debris from the entire surface of the water with a single sweep of the skimmer screen through the water.

Other objects and advantages of the present invention will be readily apparent to those of ordinary skill in the art, as well as various adaptations and modifications, from the succeeding figures of drawing and detailed description.

BRIEF DESCRIPTION OF THE DRAWINGS

FIG. 1 is a top view of the present device mounted at a point along the wall of the swimming pool.

FIG. 2 is an isometric view of the present device showing its roll construction and means of affixation to the swimming pool wall.

FIG. 6 is a top sectional view of an alternate embodiment including a canister which encloses the screen roll.

FIG. 7 is a side sectional view taken from FIG. 6 showing further details of the alternate embodiment.

DESCRIPTION OF THE PREFERRED EMBODIMENT

Figure 3:
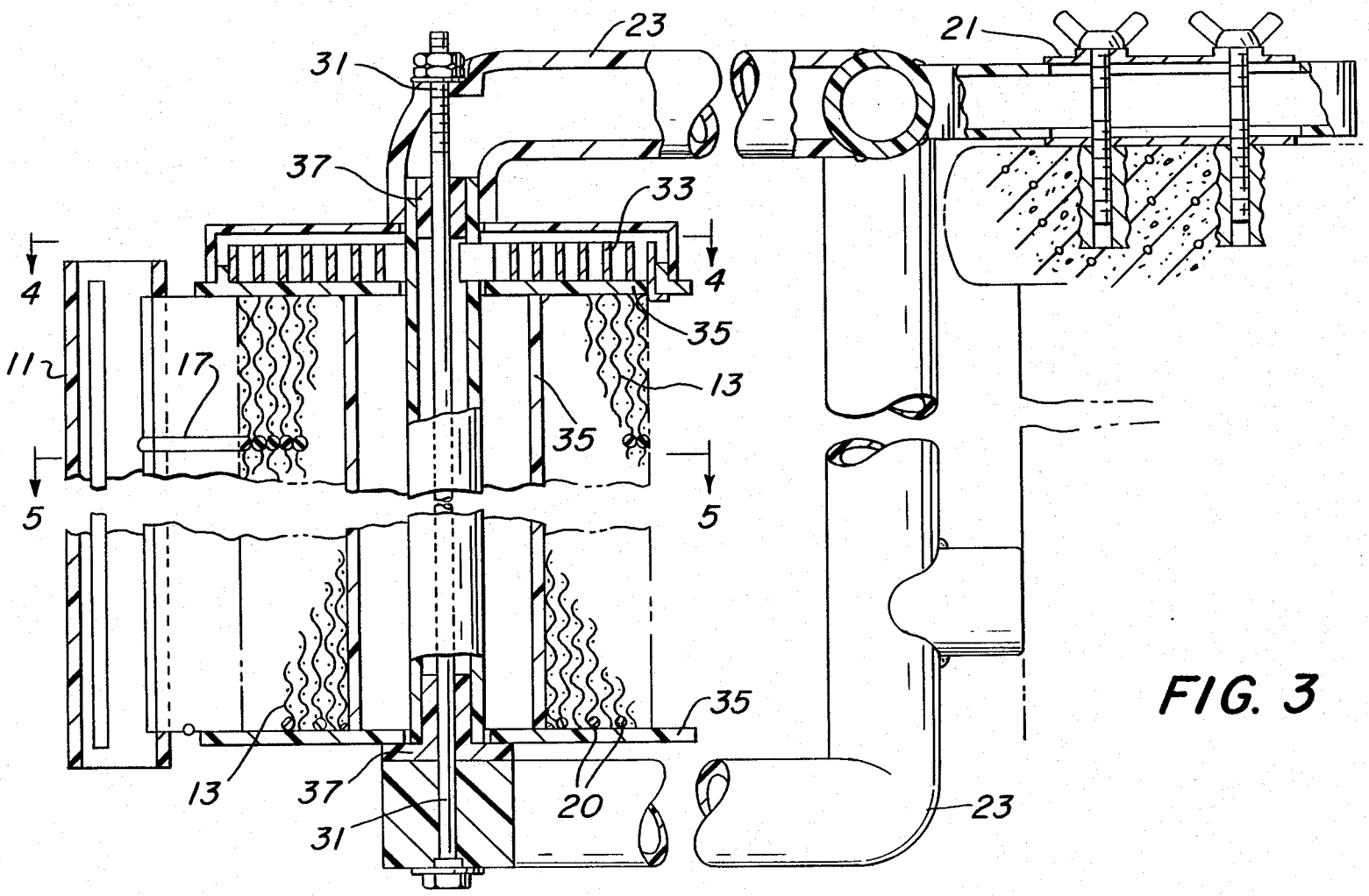
FIG. 3 is a cross-sectional view taken from FIG. 2 showing details of the construction of the recoilable screen roll and attachment means.

Referring now to FIG. 1, the present device is shown affixed to the sidewall of a swimming pool looking from above. Screen roll 27 is affixed to the pool apron 19 by bracket 21 which is fastened thereto. Frame member 23 is attached to bracket 21 and holds the screen roll in a vertical position along the side of the pool. Screen web 13 runs between the roll and wand collar 11. Depicted in phantom lines, the skimmer screen 13 is shown in various positions as the collar 11 is led around the outer edge of the swimming pool in the direction shown by arrow 25.

Referring now to FIG. 2, an isometric view of the screen roll and supporting frame is shown. Bracket 21 secures frame members 23 to the side of the pool, thereby the screen roll 27 is held a short distance from the side of the pool in a rigid, vertical position. The height of the screen roll is positioned partly submerged so that the water line (not shown) falls approximately in middle of the screen. A spacer cord 17 is attached along the surface of the skimmer screen in order to maintain spacing between layers of the screen as it wraps up. Small weights 20 are positioned along the bottom edge of screen 13 in order to help orient the screen in a vertical position as it is pulled through the water. Referring now to FIG. 3, greater detail of the screen spool assembly is shown. Frame 23 supports vertical axle 31 which determines the axis of rotation of spool 35 which is supported on bushings 37 located at the top and bottom of the spool. Collar 11 is located at one end of the screening 13 which is a tube dimensioned to receive wand 29 (not shown in this figure, but shown in FIG. 2).

Figure 4:
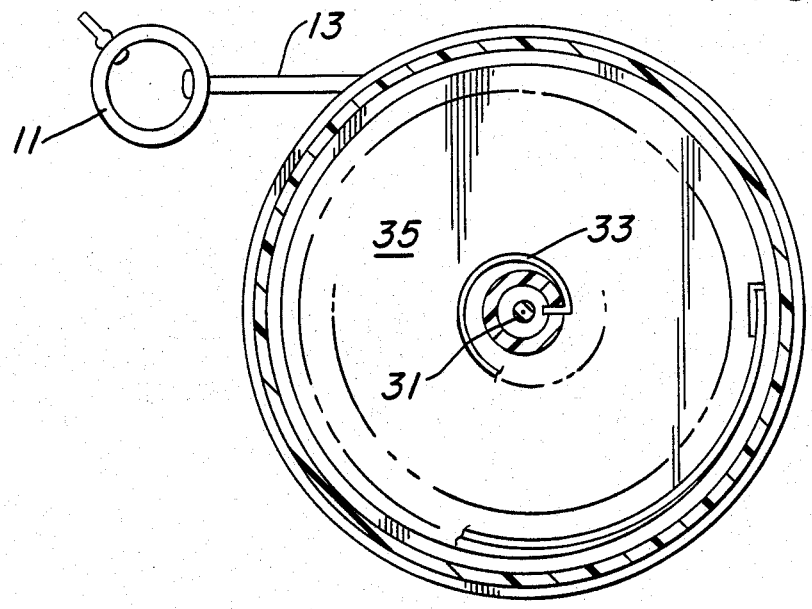
FIG. 4 is a top sectional view taken from FIG. 3 showing details of the recoil spring mechanism.

Referring now to FIG. 4, a top sectional view taken from FIG. 3 is shown showing details of coil spring 33 located at the top of the screen spool.

Figure 5:
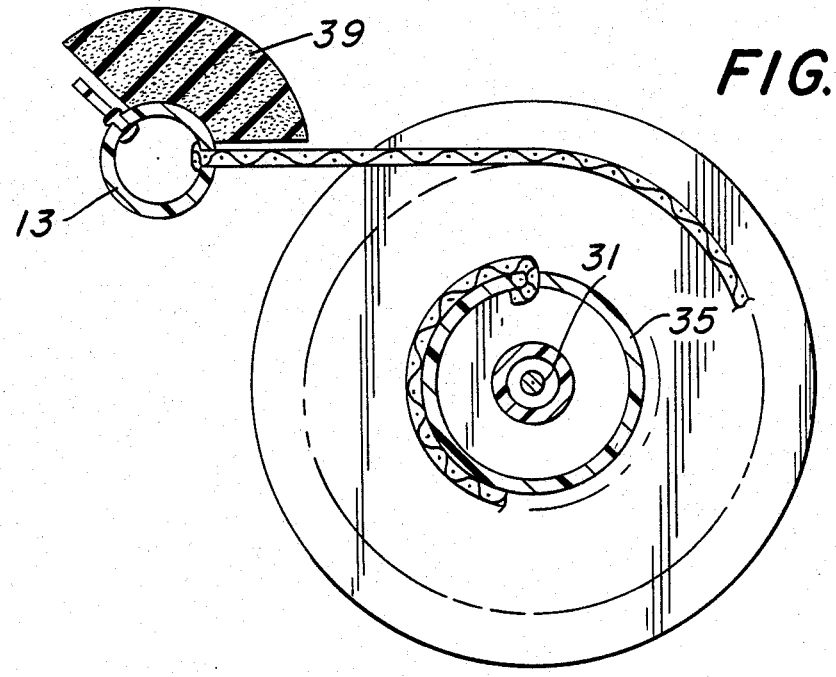
FIG. 5 is a mid-sectional view taken from FIG. 3 showing details of the wand collar and wiper block construction.

FIG. 5 shows an alternate embodiment wherein wiper block 39 is added to collar 11.

FIGS. 6 and 7 show an alternate embodiment further including an outer canister 43 with wiper brushes 41 attached thereto. As debris-laden screening is coiled onto the roll, it enters canister 43 by way of vertical slot 42 and debris is brushed from both sides of the screening by brushes 41. Debris will then be contained in the outer portion of the canister 44; or, if it is non-floatable, it will fall into the lower portion of the canister 49 through aperture 45. In this way, all of the debris collected is contained within the canister after the skimming operation. Later, the canister may be removed from the frame 23 and carried to a remote location where debris accumulated within the canister can be emptied.

OPERATION

Operation of the present device is extremely simple. As shown in FIG. 2, the wand 29 fits conveniently into collar 11 at one end of the skimmer screen. As shown in FIG. 1, the wand is held vertically and one end of the skimmer screen is led around the edge of the pool with the collar wiper 39 (more clearly depicted in FIG. 5) held in contacting relation with the sidewall of the pool. Hence, the screen sweeps across the entire surface of the pool. During this process, any floating debris is accumulated along the leading face of the skimmer screen, or is herded by this process into a small area adjacent to the screen roll when the wiper returns back to the home position of the screen roll. As can be clearly seen from FIG. 1, this process requires the skimmer screen to be first extended from and then retracted back into a rolled position. Debris is either pulled back into the roll and trapped within layers of the wound-up screen or herded into a compact area near the home position of the screen roll. There it can be quickly lifted out with the usual skimmer scoop or directed into the skimmer trap which is preferably located adjacent thereto.

When the embodiment which employs the outer canister is used, debris will not be trapped between layers of the wound up screening, but will be brushed from either side of the screening and accumulated within the canister.

It should be understood that the above description discloses specific embodiments of the present invention and are for purposes of illustration only. There may be other modifications and changes obvious to those of ordinary skill in the art which fall within the scope of the present invention which should be limited only by the following claims and their legal equivalents.

What is claimed is:

1. A swimming pool skimmer, comprising:

a. a swimming pool having a substantially vertical outer wall, b. a frame affixed to said outer wall, c. a vertically oriented, resiliently rotatable spool affixed to said frame, said spool being partially submerged in said pool, d. a length of screening in the shape of an elongate rectangular web affixed at a first end to, and in wraps coiled about, said spool, and e. means for pulling said screening away from the spool while holding said screening in a vertical orientation with portions of said screening above and below the surface of water in the pool.

2. The swimming pool skimmer of claim 1 wherein said means for pulling includes a wand with a handle releaseably affixed to a second end of said screening opposite said first end.

3. The swimming pool skimmer of claim 2 further including a plurality of weights in spaced relation affixed to the bottom edge of said screening.

4. The swimming pool skimmer of claim 3 further including a collar for receiving said wand, said collar being affixed to said second end of the screening.

5. The swimming pool skimmer of claim 4 further including a wiper block affixed to said collar.

6. The swimming pool skimmer of claim 5 further including a cord located along the surface of the screening to space apart the coiled wraps of the screen.

7. The swimming pool skimmer of claim 6 further including coil spring means affixed between said spool and said frame for recoiling said spool and thereby retracting said screening.

8. The swimming pool skimmer of claim 7 further including an outer canister affixed to said frame and enclosing said spool.

9. The swimming pool skimmer of claim 8 further including vertically disposed brushes affixed to said canister, said brushes disposed along the path of said screening and contacting opposite sides thereof.

* * * * *